US006668478B2

(12) United States Patent
Bergstrom

(10) Patent No.: US 6,668,478 B2
(45) Date of Patent: Dec. 30, 2003

(54) FIREARM PNEUMATIC COUNTER-RECOIL MODULATOR & AIRGUN THRUST-ADJUSTOR

(76) Inventor: Jason Bergstrom, 561 Smith St., Harrisburg, OR (US) 97446

( * ) Notice: Subject to any disclaimer, the term of this patent is extended or adjusted under 35 U.S.C. 154(b) by 0 days.

(21) Appl. No.: 10/002,688

(22) Filed: Dec. 5, 2001

(65) Prior Publication Data

US 2002/0178901 A1 Dec. 5, 2002

(51) Int. Cl.[7] ..... F41A 25/02

(52) U.S. Cl. ..... 42/1.06; 89/199; 89/198

(58) Field of Search ..... 89/198, 199; 42/1.06, 42/74; 267/195

(56) References Cited

U.S. PATENT DOCUMENTS

| | | | | | |
|---|---|---|---|---|---|
| 836,502 | A | | 11/1906 | Johnson | |
| 900,865 | A | | 10/1908 | Louis | |
| 1,398,452 | A | | 11/1921 | Wagnon | |
| 3,298,282 | A | | 1/1967 | Loffer | 89/198 |
| 3,362,508 | A | * | 1/1968 | Mayer | 188/283.1 |
| 3,742,636 | A | * | 7/1973 | Dealy et al. | 42/111 |
| 3,901,125 | A | | 8/1975 | Raville | 89/163 |
| 4,026,054 | A | * | 5/1977 | Snyder | 42/115 |
| 4,156,979 | A | * | 6/1979 | Katsenes | 42/1.06 |
| 4,307,653 | A | * | 12/1981 | Goes et al. | 89/198 |
| 4,388,855 | A | | 6/1983 | Sokolovsky | 89/198 |
| 4,492,050 | A | * | 1/1985 | Kagehiro | 42/1.06 |
| 4,709,686 | A | | 12/1987 | Taylor et al. | 124/67 |
| 4,736,931 | A | * | 4/1988 | Christopherson | 267/34 |
| 4,771,758 | A | | 9/1988 | Taylor et al. | 124/68 |
| 4,774,873 | A | * | 10/1988 | Shoales | 89/43.01 |
| 4,850,329 | A | | 7/1989 | Taylor et al. | 124/68 |
| 4,986,018 | A | * | 1/1991 | McDonald, Jr. | 42/1.06 |
| 5,265,852 | A | | 11/1993 | Taylor | 267/119 |
| 5,367,812 | A | * | 11/1994 | Lautrec | 42/74 |
| 5,524,374 | A | * | 6/1996 | Gernstein | 42/1.06 |
| 5,528,258 | A | * | 6/1996 | Moon | 345/110 |
| 5,617,664 | A | * | 4/1997 | Troncoso | 42/1.06 |
| 5,706,920 | A | * | 1/1998 | Pees et al. | 188/322.17 |
| 5,909,002 | A | * | 6/1999 | Atchisson | 89/130 |
| 5,941,005 | A | * | 8/1999 | Battaglia et al. | 42/70.08 |
| 5,983,549 | A | * | 11/1999 | Battaglia | 42/17 |
| 6,300,404 | B2 | * | 10/2001 | Nishimura et al. | 524/490 |
| 6,520,493 | B2 | * | 2/2003 | Larsen | 267/201 |

FOREIGN PATENT DOCUMENTS

FR 547220 * 8/1956

OTHER PUBLICATIONS

Provisional patent application by Applicant Searine Ser. No.– #06/250,372, Filing date: Dec. 1, 2000.

U.S. Pat. Office Disclosure Document: #487,972 Filed: Jan. 30, 2001.

U.S. Pat Office Disclosure Document: #487,973 Filed: Jan. 30, 2001.

* cited by examiner

*Primary Examiner*—Michael J. Carone

(57) ABSTRACT

An inexpensive generally retrofitable drop-in cartridge-unit of light-weight pneumatic-cylinder design for replacing the conventional metal/compression-spring member housed within the frame of a gun, thereby providing significantly smoother, quiter, more rapid, and more reliable cyclic-action upon firing of the gun. The preferred embodiment cartridge-unit is internally configured whereby a near constant spring-load rise is provided as the bolt-action slides aftward, thereby effectively spreading resultant recoil-action inertial-kickback more evenly throughout the bolt-travel. Hence, substantially reducing disturbing kickback, enabling a more rapid succession of shots per given shot-grouping owing to the shooter's improved recovery-time. Various iterations are set forth, including those of single, double, and tripple telescopic-action, and a hybrid/metal-pneumatic variant, as well as generic-variants providing manual and automatic pneumatic-pressure adjustment. Plus, a further iteration facilitating manual adjustment of air-gun thrust-pressure.

1 Claim, 4 Drawing Sheets

Fig.~1
PRIOR-ART
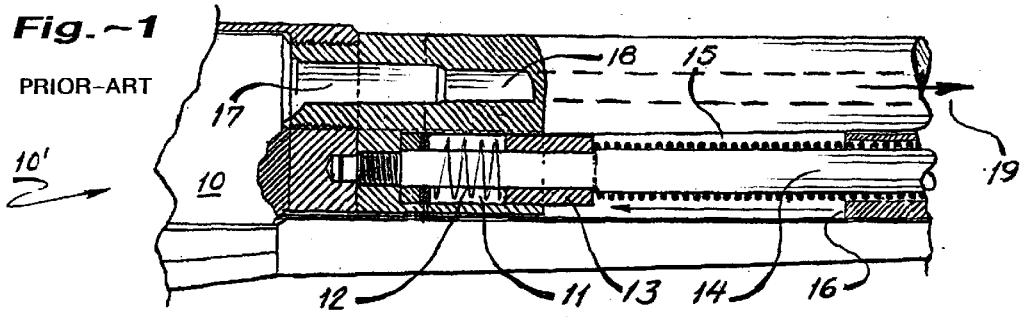
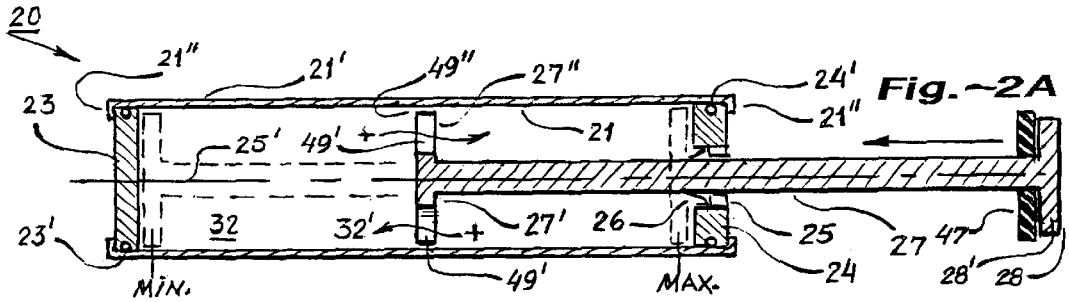
Fig.~2A
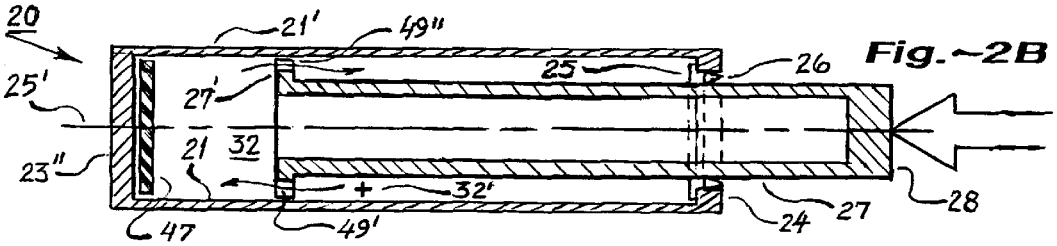
Fig.~2B
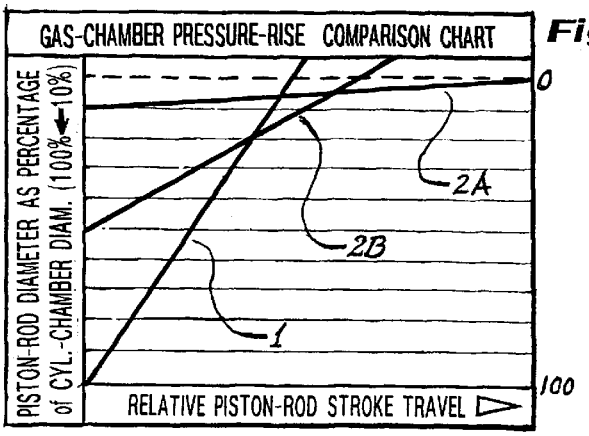
Fig.~2C

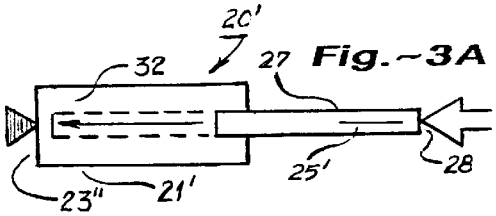
Fig.~3A
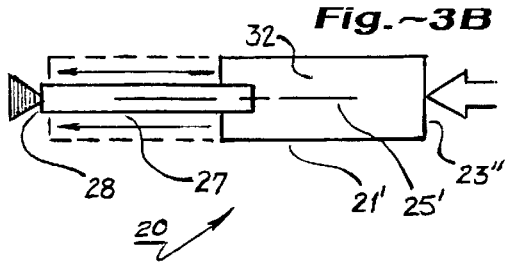
Fig.~3B
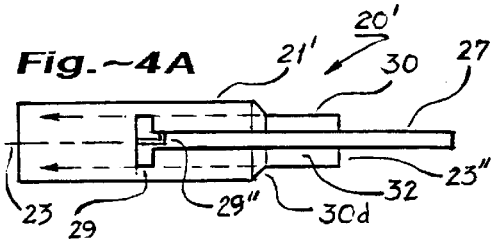
Fig.~4A
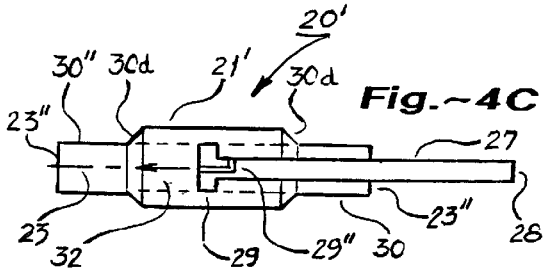
Fig.~4C
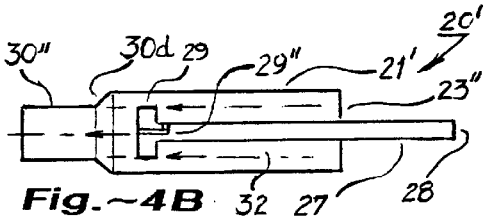
Fig.~4B
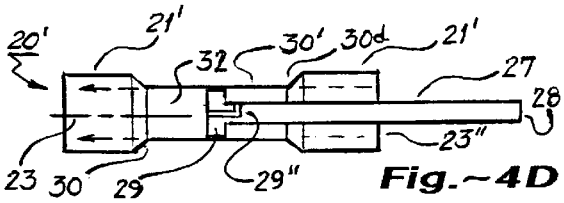
Fig.~4D

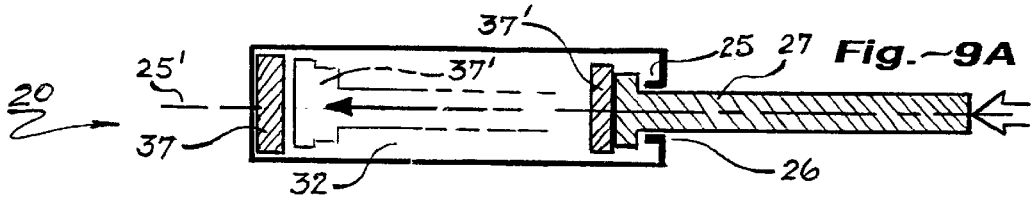
Fig.—9A
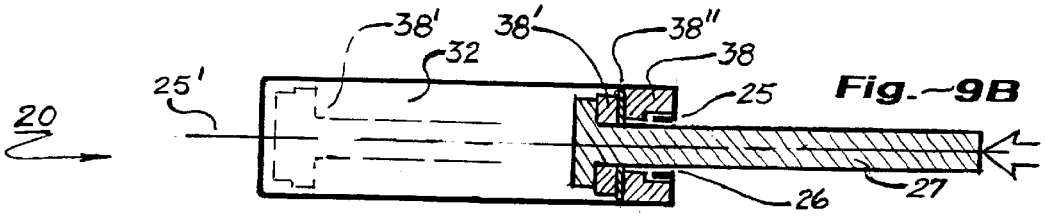
Fig.—9B
Fig.—10A
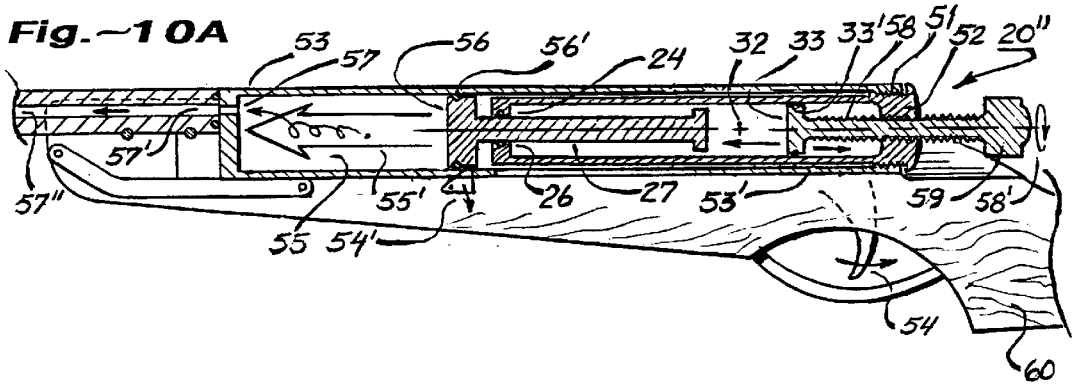
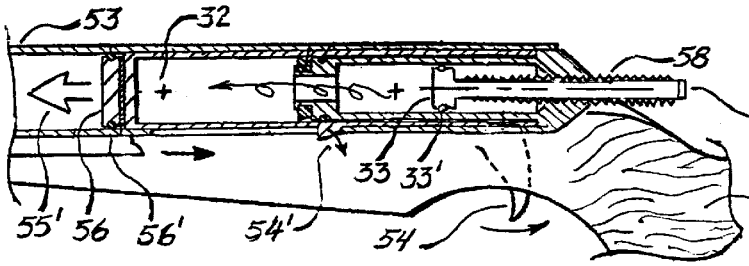
Fig.—10B

FIREARM PNEUMATIC COUNTER-RECOIL MODULATOR & AIRGUN THRUST-ADJUSTOR

I.) BACKGROUND OF THE INVENTION

1. Field of the Invention

This invention relates to recoil reducing buffering (or attenuating) devices for firearm (employing an explosive charge) guns of various types, sizes, and degrees of automation; and more specifically, it relates to those types of counter-recoil apparatus employing a pneumatic-cylinder as its primary kinetic-energy absorption mechanism for both reducing mechanical-shock to the gun-structure, and to improve aiming-accuracy by reduction of "aim throw-off" imposed by each firing kick-back; —also, the disclosure sets forth features to provide improved projectile powering means applicable to air-guns.

2. Relevant Prior-Art

Background research discovery provides some prior patent-art regarded as germane to this disclosure, chronologically for example U.S. Pat. No. 836,502 (Filed: April 1906) shows a portion of an early automated firearm breech employing a built-in air-chamber fitted with an annular plunger-piston acting against a recoil-spring while engaged forwardly by a rearwardly recoiling-rod member of the breech mechanism.

In U.S. Pat. No. 900,865 (Filed: March 1907) is shown an automatic magazine-fed handgun having a built-in air-chamber fitted with a plunger-piston, whereby the tubular air-chamber reacts aftward around the plunger-piston.

In U.S. Pat. No. 1,297,240 (Filed: December 1916) is shown an automatic machine-gun having a built-in air-chamber fitted with a plunger-piston, whereby rearward action of the breech-bolt is rebuffed via both a recoil-spring and the momentary compression of captive air which reactively induced compression is regulatable via an adjustable screw-adjusted relief-valve device.

In U.S. Pat. No. 1,398,452 (Filed: September 1919) is shown an automatic-rifle having an aftwardly built-in air-chamber and breech-piston arrangement obviating need of a recoil-spring.

In U.S. Pat. No. 1,351,141 (Filed: April 1920) is shown a hydraulic (oil filled) recoil-buffer spool device for automated firearms, wherein a restricting orifice is staged between two longitudinally opposite chambers; and whereby a discharge of breech pressurized oil is forced past a preferably tapered longitudinal needle-valve arranged coaxially within said orifice. The arrangement in combination with a substantially conventional recoil-spring thus serving to modulate the otherwise jolt of sliding-bolt action upon firing of the gun.

In U.S. Pat. No. 3,3298,282 (Filed: February 1965 from Germany) is shown a built-in pneumatic recoil modulator device in combination with a conventional recoil-spring for automatic type firearms, wherein a fixed full-area piston is driven within an aftwardly traveling tubular breech extension chamber; the piston thus acting in concert with the helical-spring to more smoothly arrest aftward travel of the breech-bolt.

In U.S. Pat. No. 3,636,813 (Filed: June 1969 from Germany) is shown an elaborate dual-cylinder hydraulic counter-recoil device employing full-area pistons acting within a pair of tubular barrels; which apparatus is intended for modulating the inertia-forces of recoil encountered in relatively heavy artillery weaponry thus unsuitable for hand-portable guns.

In U.S. Pat. No. 3,599,530 (Filed: November 1969) is shown an elaborate said automatic-replenisher for the hydro-pneumatic recoil systems of relatively large caliber weaponry; unsuitable for hand-portable guns.

In U.S. Pat. No. 3,901,125 (Filed: March 1973) is exemplified an automatic-pistol of the popular Colt/45-caliber sidearm type, wherein is provided a combination conventional recoil-spring and a fixed delayed-action pneumatic-chamber driven over-upon by an aftward moving cupped front breech-plug (92), whereupon piston 102 (having an O-ring seal) ensues to build-up a compressive resistance to the recoiling breech inertia. The inventor teaches that the greater breach-loading sustained by the higher recoil-resistance, enables the sent projectile to travel further down the barrel before the bolt opens, allegedly improving aiming accuracy and repeated firing comfort owing to reduced "kick". The pneumatic members are at ambient-pressure (not pre-pressurized) prior to firing, and a resilient rubber-cushion (132) is required to absorb final travel; —some contemplation is given to a retrofitable pneumatic device adaptable to such an older gun (col.-3/lines. 4–15).

In U.S. Pat. No 4,307,653 (Filed: September 1979) and U.S. Pat. No. 4,445,644 (Filed: May 1981) are shown generic variants of a recoil buffer with interacting first and second gas-chambers (note: —neither of which is pre-pressurized, and some iterations include an oil medium), wherein upon recoil after firing, a compressive force is applied to the first chamber, whereby a gas/pressure-differential is generated between first and second longitudinal chambers, thus producing a gas flow into the second chamber via a venting fluid-diode restrictor device; hence, the apparatus is a type of shock-absorber only, still requiring a conventional metal recoil-spring for cyclic-action.

In U.S. Pat. No. 4,388,855 (Filed: October 1980) is shown a built-in pneumatic decelerator device for a firearm, wherein a breech air-chamber (8, not pre-pressurized) also contains a metal recoil-spring (60) and is moved aftwardly upon firing of the gun, causing fixed hollow piston member (12) to effectively slide into the air-chamber, thus compressing both the spring and the air captive therein.

In U.S. Pat. No. 4,492,050 (Filed: April 1983 from U.K.) is shown an air-powered gun having a gas-tight pressure-chamber for launching a projectile, which chamber is pressurized via a manually-actuated cocking-pump, and has no relevance to combating recoil action.

In U.S. Pat. Nos. 4,850,329 & 5,193,517 (Filed: January 1988 & June 1991) from U.K. by the Theoben-group; Is shown a firing-mechanism for air-powered guns, wherein a longitudinal cylinder (4) with an internally sliding primary-piston (5) having an extended-skirt portion also contains a free-sliding bobbin-piston (1) acting as an inertial-mass within the extended-skirt; said bobbin-piston having an axial air-port and an optional coil-spring urging bobbin-piston toward the gun's discharge-port, the effect of which is to reduce accuracy disturbing kinetic-energy at the end of the primary-piston's projectile launching travel.

In U.S. Pat. No. 5,076,139 (Filed: August 1990) is shown an exemplified conventional semi-automatic Beretta(mfg.) side-arm gun said to have a problematical hammering condition of the slide against the frame at maximum slide-travel, which creates destructing structural cracks in the frame. A resilient shim-like buffer device is thus retrofitable, which is said to significantly relieve the peak-loads imposed upon the frame; however, the simple device only treats the symptom, and does not eliminate the inherent mechanical defect inherent in this metal recoil-spring design.

In U.S. Pat. No. 5,265,852 (Filed: October 1991) is shown a gas-spring of the type employed widely in the tooling-Industry to reduce shock-forces encountered during mating of metal-dies; and noteworthy here is the use of a rod-like piston member, which owing to it's reduced piston-area relative to the cylinder-bore cross-section, is able to travel within the cylinder without creating excessive increase in Internal working-pressure (as compared to a full-area piston operating within a closed cylinder).

In U.S. Pat. No. 5,339,789 (Filed: July 1992 from Germany) is shown a low-recoil air-rifle, whereto the gun-mechanism referenced by the gun-barrel/breech (20) is mounted atop a wooden-stock portion (26), whereto a special mounting is provided between the gun-barrel and the gun-stock, which employs a roller and inclined-ramp mechanism serving to alter the vector of recoil-forces sufficiently as to greatly reduce loss of target in the sights upon firing of the air-rifle. However, such an extensive alteration to conventional existing guns is not a prectical consideration.

In U.S. Pat. No. 5,513,730 (Filed: September 1995) is shown a so-called non-linear longitudinal recoil/shock-absorber apparatus for mounting abaxially to a gun-barrel for example, so as to react in a manner said to reduce recoil kick upon firing of the gun. A specially configured helical-spring is located inside the cylinderical body of the shock-absorber, which becomes axially torqued as to cause the spring to diametrically expand and impinge frictionally against the internal-wall of the cylinder chamber containing oil. However, it is believed that after extended use, the level of shock-absorption deteriorates owing to internal wear.

In U.S. Pat. No. 5,727,286 (Filed: March 1996 from Taiwan) is shown a pneumatic door-closer of the elongate cylinder type, having an adjustable/needle-valve at the otherwise occluded end of the cylinder, and a piston-shaft extending oppositely from the cylinder. However, the internal piston-head is of the full-area type, and the primary feature of the invention is a two-stage linear-action loading, whereby internal-steps upon both the cylinder-wall and the piston-shaft facilitates a convenient "hold-extended" function, until the user applies an overcoming retraction force, whereby the piston-shaft is biased back inward of the cylinder.

In U.S. Pat. No. 5,797,593 (Filed: December 1996from Japan) is shown an oil-dampened cylindrical so-called gas-spring apparatus common to modern automotive use as a hatch-strut, which is referenced here primarily owing to its pre-pressurized factory-sealed swedged-over non-rechargable O-ring construction.

In U.S. Pat. No. 6,059,273 (Filed: February 1995 from Sweden) is shown a cylinderical gas-spring having a full-area piston-head designed to provide relatively light initial longitudinal axial/thrust-resistance of the outwardly extending piston-shaft (4), and includes a cooperating donut-piston sliding internally on the piston-shaft, whereby greater resistance is provided once the piston-shaft has receeded slightly into the cylinder; this variable resistance action being facilitated via the internal gas-pressure/differential being imposed upon the full piston face versus the piston's partial opposite-side surface-area.

Therefore, in full consideration of the preceding patent review, there is determined a need for an improved form of device to which these patents have been largely addressed. The instant inventor hereof believes their newly improved firearm recoil pneumatic modulator device, commercially referred to as the RECOILX-Cartridge™, currently being developed for production under auspices of the Bergstrom-Mfg./Mkt.Co., exhibits certain advantages as shall be revealed in the subsequent portion of this instant disclosure.

II.) SUMMARY OF THE INVENTION

A.) In view of the foregoing discussion about the earlier invention art, it is therefore important to make it pellucid to others interested in the art that the object of this instant invention disclosure is to provide a cylindrical preferably "drop-in" pneumatic unit in place of a conventional helically-coiled steel recoil-spring heretofore typically existing within the breech-mechanism or stock-region of a conventional gun (rifled-bore firearm) or a conventional shotgun (smooth-bore firearm) of both semi-automatic and fully-automatic types thereof (as well as those heavier sorts of firearm weaponry such as semi-automatic shotguns, submachine-guns, plus military granade-launchers and cannons); —which serves to improve the firearm's so called recoil-action characteristic by generally making the rate of breech opening and closing more constant as compared to that rate characteristic of metal helically-wound metal (generally carbon-steel) recoil-springs.

By replacing (OEM-substituting or aftermarket retrofitting) a conventional recoil-spring with my novel gas-spring apparatus, the former progressive-rate metal/compression-spring (becoming very increasingly resistive as the breech-mechanism travels aftward) action becomes transformed into a nearly constant-rate of recoil-action provided by my special pneumatic/compression-spring. My basic gas-spring unit also greatly abrogates the usual spring-noise resonance (virtually eliminating familiar "cah'ching" like vibration), while obviating off-axis (longitudinal-axis) forces, whereby reduced cycling-time (improving firing-rate), and a substantially reduced "kick" is realized; —which improved recovery-time (time required to realign a gun's sights upon target) correlates to a consistently tighter grouping of shots at any demonstrated target distance, and significantly quieter, smoother, and more precision feeling firing-action; —which is thus also substantially less stressful to both gun and gunner. Accordingly, it is further asserted that these types of guns can also now be keenly redesigned as to take advantage of the significantly lower gun-frame stesses imposed by our particular gas-spring cartridge configuration, when offered as a standard OEM(original equipment manufacturer) provision.

B.) Another object of this invention disclosure is to set forth a gas-spring apparatus preferably in the form of a removable cartridge unit according to preceding item-A; wherein the cross-sectional area of the piston within the fluid-cylinder body of the cartridge is preferably substantially smaller than the cross-sectional area of the fluid-cylinder, whereby I thus refer to the piston generally as a piston-rod, owing that it preferably is less than half the cross-sectional area of the fluid-cylinder itself. Therefore, as the piston-rod makes its stroke through the fluid-cylinder, the relative differential-ratio of piston-rod cross-section diameter to cylinder cross-sectional diameter thus enables a so-called near constant compressive resistance of the piston-rod as it is plunged into the cylinderical gas-chamber of the cylinder-body. Moreover, owing to this preferred relatively diminutive effective piston-diameter, there are preferably no fluid gas-tight seals moving with the piston-rod; the fluid-seals rather being preferably fixed within the entry-bore through which the piston-rod travels. The cylinder-body is preferably of conventional circular cross-section configuration, although a non-circular shape could optionally sulfice if such were desired.

Hence, it is necessarily understood that as the manufacturing design-engineer changes the critical diameter of the piston-rod relative to the diameter of the cylinder-body, a given factory-filled static-pressure setting withstanding, —the characteristic increase in dynamic-pressure (a product of relative gas-chamber diameter X recoil-stroke length or travel) can now be virtually tailored to the design-engineer's preference, from a nearly flat or "near constant" compression energy profile when plotted as a graphic-chart, to a relatively steeply sloped profile compression-pressure rise more approximating that of a conventional metal/recoil-spring (albeit absent of adverse spurious mechanical aberrations characteristic of compression-springs), —simply by designing the piston-rod to a diameter approximating that of the cylinder within which it is operating.

In most gun applications, the ideal passive (not introducing spurious mechanical aberrations) rebuffing action enabled by invention of this disclosure, is to realize the afore stated near constant fluidic compression pressure-rise within the gas-chamber, as the piston-rod is being driven into the gas-chamber by the gun's conventional breach action. Understandably, the diameter of the piston-rod must necessarily be designed in keeping with the degree of counter-pressure required to sustain the imposed force of the recoil-action; —plus, in some cases, owing to excessively confined operating-space, I am also setting forth generic-variant cartridge iterations employing compound telescopic configurations (such as a piston-rod within a piston-rod, acting either in the same direction or in opposite directions).

Generally speaking however, my cartridges are employed in a manner whereby the cylinder body portion is fixed, the usually lighter-weight piston-rod member thus acting therein against fluid-pressure, —moves during recoil action; —however if preferred, the converse arrangement can be adapted, whereby the piston-rod remains fixed and instead the cylinder-body moves yieldingly to the gun's breech-mechanism. Alternately, it is also possible in some guns, that both the cylinder-body and the piston-rod move relative to one another; —either of these three implementations nevertheless achieving the object of eliminating the conventional metal/recoil-spring as shall be illustrated later herein.

Another design option is to employ seals having different coefficient-of-friction drag-loading (lighter or heavier slip-resistance) acting upon the piston-rod; a light loading generally being more suitable for guns having a positive breech locking mechanism, while a heavier type of seal-drag characteristic of generally greater contact-area is considered to be particularly appropriate for guns inherently relying upon the initial breakaway-resistance of the breech block mechanism to build-up breech-chamber pressure.

C.) Another object of this invention disclosure is to set forth the gas-spring apparatus for firearms in the form of a preferably removable drop-in cartridge unit according to preceding items-A&B, wherein the first/end-wall (or head end) portion forming the forward end of the longitudinal cylindrical body's imperforate gas-chamber no preferably also forms a longitudinally arranged secondary/cylindrical-chamber within which is contained a free-floating inertial-mass device. This novel inertial-mass serves to effectively prolong the forward impulse during closure-sequence of a conventional breech-mechanism in a semi or-automatic or full-automatic firearm, the inertial-mass normally being held aftward within the secondary/cylindrical-chamber by a shuttle/compression-spring. In some such firearms, as the aftwardly driven bolt commences to engage and scoop the next round of ammunition slidably forward into the breech chamber, whereby the bolt necessarily becomes secured forwardly in some way (such as via a rotational cam-locking action), an irregularly-sized round or mere dirt can cause difficulty with this cyclic procedure, resulting in a so-called "bounce-back" event and a jam like misfire of that round (which must usually be manually cleared). Hence, I have found that the presence of an assisting secondary/inertial-mass can provide sufficient additional urging (in addition to that being provided by our gas-spring portion alone) of breech-bolt closure as to virtually overcome the impediment and efficiently drive the breech-bolt mechanism into its fully forward and securely locked position. The secondary/inertial-mass is basically a type of active-weight such as a heavy metal slug or collar, or even particulates (such as loose lead-shot), in any case necessarily normally held rearwardly in some way; —accordingly, as the primary-mass comes to a halt, the secondary/inertial-mass continues to thus move forward sufficiently as to effectively prolong the closing force of the breech-bolt.

D.) Another object of this invention disclosure is to set forth the gas-spring article for firearms in the form of a preferably removable drop-in cartridge unit according to preceding items-A&B, wherein I have found that some firearm implementations benefit from a novel two-in-one combination of our gas-spring operating as an assembly in longitudinal cooperation with a "booster" metal/compression-spring member arranged coaxially to the gas-spring casing for those firearm applications where an increased breech closing speed is needed. Another iteration of this objective is to alternately include a "magnetic-spring" comprising a pair of rare-earth (preferably of neodymium type) permanent-magnets, PM-1 being arranged fixed with the gas-spring cartridge cylinder go aftward end-wall, the requisite opposing PM-2 being affixed to the inboard-terminus of the piston-rod. Thus, with their interfacing magnetic-poles arranged necessarily either plus-to-plus (+:+) or equivalently minus-to-minus (−:−), a powerful resistive energy is resultantly encountered as the piston-rod approaches its momentary aftwardly driven position.

Another related iteration of this magnetic complement to the basic gas-spring cartridge unit is in the form of a resistive-breakaway configuration, whereby the PM-1' member is affixed to the inboard-terminus of the piston-rod so as to attractively interact with a PM-2' an annular (encircling the concentric piston-rod) magnet affixed proximal the forward end-wall of the cartridge body. In this alternate magnetic embodiment, the function of the interacting Permanent-magnets (PM-1' & PM-2') is to generate a high initial-breakaway resistance, which would be particularly useful in possibly entirely obviating need for a mechanical breakaway-cam type of breech-mechanism. Thus, with their interfacing magnetic-poles arranged necessarily either plus-to-minus (+:−) or equivalently minus-to-plus (−:+), a powerful attractive magnetic-energy field is resultantly encountered as the piston-rod's inward-terminus portion approaches its normal forwardly resting position.

E.) Another object of this invention disclosure is to set forth the gas-spring article for firearms in the form of a preferably removable drop-in cartridge unit substantially according to preceding items-A&B, yet wherein the cylindrical-wall bore portion however can be configured at the factory with variable diameters along the piston-rod's linear path, enabling the designer still further options in the form of operating characteristics.

Accordingly, four such generic-variations are being set forth, essentially as follows: —all employing a piston-rod having a piston-head with an annular-seal which impinges against a reduced diameter (necked-down) portion of the cylindrical-chamber. However, in this embodiment the piston-head becomes effective only in selective portions of the gas-chamber; for example the cylindrical-wall diameter is in the generic variations of this embodiment narrowed either forwardly, aftwardly, forwardly & afterwardly, or only centrally (approximately medially), —thereby modifying both the pneumatic and frictional resistance and rate characteristics at which the piston-rod translates through the cylindrical-chamber.

A further generic-variant embodiment of this iteration can be realized by optionally eliminating the annular-seal from the piston-head, and establishing a critically sized by leakage-gap relative to any necked-down cylindrical-wall surfacing; thereby enabling the designer to variably regulate rate of piston-rod movement throughout the travel of the piston-rod upon firing of the gun.

F.) Another object of this invention disclosure is to set forth the gas-spring article for firearms in the form of a preferably removable drop-in cartridge unit according to preceding items-A&B, wherein the longitudinal cylindrical body of our gas-spring cartridge includes a slider-piston having an annular-seal impinging radially upon the inside-diameter of the cylindrical body while supported against the constant thrust of gas-chamber pressure via an externally adjustable preferably male/screw-threaded member acting in cooperation upon mating female/screw-threads provided upon the tubular piston-rod. Hence, the slider-piston serves to conveniently enable a degree of user adjustment of the gas-chamber positive-pressure by resultantly displacing the slider-piston forward (increasing chamber pressure) or aftward (reducing chamber pressure) relative to the gas-chamber as may be desired by the user; for example, in order to thereby tunably compensate for different types of ammunition, which explosive force directly effects the recoil reaction of the gun.

G. ) Another object of this invention relates specifically to air-powered guns instead of explosive-powered guns, wherein is provided a novel manually-selective pressure-modulator device, enabling convenient adjusting of the potential propulsive force contained within the gas-spring propulsion-chamber, which instead of an explosive-charge, serves to thrust a projectile from a conventional compressed-gas (generally air) powered gun. The overall gas-spring principle operating in similar fashion to our afore covered uniquely adjustable gas/recoil-spring for firearms, described in preceding item-C.

The pressure-modulator preferably basically comprises a longitudinally slidable attenuator-piston arranged aftwardly within the imperforate cylinderical-chamber of the air-gun's manually actuated gas/propulsion-spring chamber (having a longitudinal-axis) and a trigger released manually recockable longitudinally reciprocating-piston having a forward thruster-head acting to launch a projectile placed within the staging-chamber of the gun's longitudinal barrel-bore. The attenuator-piston is provided with a coaxial screw-threaded adjustor-shank extending longitudinally aftward from the air-guns's cylindrical-chamber; whereby manual rotation of the adjustor-shank (clockwise or counter-clockwise) moves the attenuator-piston forward or aftward, as to thereby effectively vary the compression-ratio of the air contained captively within the cylindrical-chamber as desired by the gunner.

H.) GENERAL SUMMARY OF ADVANTAGES: —our Gas-spring serves to provide the following benefits . . . a.) to substantially reduce recoil; b.) to significantly improve time to aim; c.) to minimize vibration gain smoothness; d.) to eliminate spring noise; e.) to eliminate lateral forces; f.) to improve cycling time and durability; g.) to facilitate breech-bolt action characteristics otherwise unattainable; h.) to provide aftermarket drop-in retrofitting; i.) to enable gun-structure redesign for lighter-weight; j.) to provide quick and easy field-adjustment attuning of both firearms (breech-bolt resistance for different ammunition) and air-guns (pellet, dye-ball propulsive-thrust).

III.) DESCRIPTION OF THE PREFERRED EMBODIMENT DRAWINGS

The foregoing and still other objects of this invention will become fully apparent, along with various advantages and features of novelty residing in the present embodiments, from study of the following description of the variant generic species embodiments and study of the ensuing description of these embodiments. Wherein indicia of reference are shown to match related matter stated in the text, as well as the Claims section annexed hereto; and accordingly, a better understanding of the invention and the variant uses is intended, by reference to the drawings, which are considered as primarily exemplary and not to be therefore construed as restrictive in nature; wherein:

FIG. 1 (Prior-art), is a fragmented cutaway diagrammatic side/elevation-view looking at a right-angle to the longitudinal-axis cross-section of a built-in pneumatic(air)/recoil-spring configuration embodiment, showing the heretofore first know usage of a gas-spring device to dampen firing recoil;

FIG. 2A, is a diagrammatic side/elevation-view looking at a right-angle to the longitudinal-axis cross-section of our basic new-art gas/recoil-spring unit, wherein is taught the advantageous employment of a relatively small partial-bore width piston-rod device not having a seal moving therewith, whereby a very low modulas of chamber-pressure rise is realized;

FIG. 2B, is a is a second revealed example according to FIG. 2A, wherein a slightly larger piston-rod is shown employed, thereby resulting in a more steeply rising chamber-pressure as the piston-rod reacts in aftward recoil absorbing action, yet still advantageously lower in pressure-rise characteristic than that typified in FIG. 1;

FIG. 2C, is a graphic-chart wherein is plotted the general chamber-pressure rise characteristic contrasts between the FIG. 1(prior-art) embodiment indicated as ref.-1 and that set forth in both new-art FIGS. 2A/B;

FIG. 3A, is a diagrammatic cross-sectional side/elevation-view showing how the piston-rod portion serves as the moving member;

FIG. 3B, is a diagrammatic cross-sectional side/elevation-view showing how the cartridge-case portion can alternately serve as the moving member;

FIG. 4A, is a diagrammatic side/elevation-view revealing how the gas-spring may be alternately combined with both a full-bore piston effective along only part of the piston-rod stroke, whereby a dual-action characteristic is obtained;

FIG. 4B, is an opposite generic-variant of FIG. 3A;

FIG. 4C, is a combination generic-variant according to FIGS. 3A/B, wherein a tri-action recoil cushioning effect is exemplified;

FIG. 4D, is a compound generic-variant embodiment thereof;

FIG. 9A, is a diagrammatic side/elevation-view looking at a right-angle to the longitudinal-axis cross-section of my basic new-art gas/recoil-spring unit, wherein is included a further generic-variant embodiment revealing my novel magnetic-abutment device;

FIG. 9B, is a diagrammatic side/elevation-view looking at a right-angle to the longitudinal-axis cross-section of my basic new-art gas/recoil-spring unit, wherein is included a further generic-variant embodiment revealing my magnetic-breakaway device;

FIG. 10A, is a diagrammatic side/elevation-view looking at a right-angle to the longitudinal-axis cross-section of an air-gun's pneumatic projectile thruster-unit, wherein is also included a novel internal secondary/slider-piston device facilitating convenient external selective-adjustment of the air-gun's thrusting force;

FIG. 10B, is a diagrammatic side/elevation-view looking at a right-angle to the longitudinal-axis cross-section of an air-gun's pneumatic projectile thruster-unit, wherein is also included a novel internal secondary/slider-piston device facilitating convenient external selective-adjustment of the air-gun's thrusting force, in combination with a novel drop-in air-spring cartridge.

IV.) ITEMIZED NOMENCLATURE REFERENCES

Prior-art Features

Figure 5:
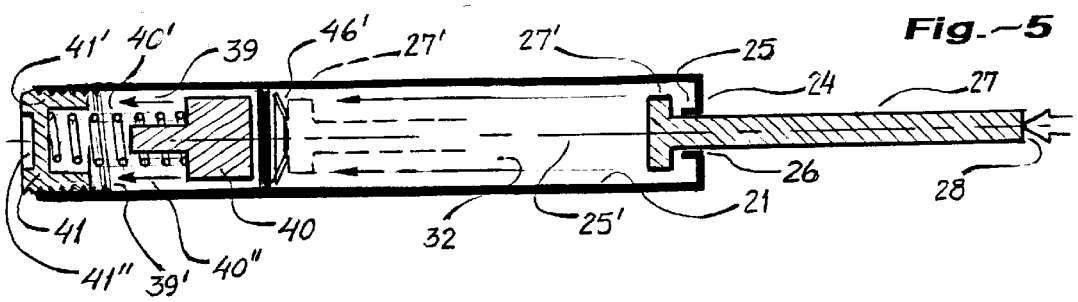
FIG. 5, is a diagrammatic side/elevation-view teaching the employment of a free-floating inertial-mass serving to further abate adverse recoil reaction.

10,10'—breech body, breech-block
11—cylindrical air-chamber
12—auxiliary recoil-spring
13—forward plunger-piston
14—fixed guide-rod
15—recoil-spring
16—recoiling-piston abutment
17—shell-chamber
18—barrel-bore
19—projectile action ref.-arrow

New-art Features

20,20',20"—basic gas-spring cartridge, stepped-diam. type, airgun type cartridge
21/21',21"—cylindrical-wall: internal-surface/external-surface, swedged-terminus
22/22'/22"—necked-down cyl.-wall: forwardly/medially/aftwardly
23,23',23"—1st end-wall, annular-seal, 1st end-wall (integrally formed)
24,24',24"—2nd end-wall, annular-seal, 2nd end-wall (integrally formed)
25,25'—support-bushing for piston-rod, longitudinal-axis of general reference
26,26'—annular-lip seal, secondary/annular-lip seal
27,27'/27"—piston-rod, piston-rod abutment-flange: small type/full radial-extensions
28,28'—piston-rod thrust-heel, optional radial extension-flange
29,29',29"—partial piston for piston-rod, leakage-gap, L-shaped vent-port
30—annular-declivity
31,31'—full piston for piston-rod, ring-seal
32,32'—gas-chamber, Positive gas-pressure
33,33'—compression-piston, annular-seal
34,34',34"—coaxial-stank, male/screw-threads, female/screw-threads
35,35'—anti-chamber, anti-chamber ambient-air vent-hole
36—free-space (compressed-gas only)
37,37'—static repulsion-magnet, dynamic repulsion-magnet
38,38',38'—static attraction-magnet, dynamic attraction-magnet, annular impact-pad
39,39'—recoil-chamber, female/screw-threads
40,40',40"—inertial-mass device, counter-spring, action ref.-arrow
41,41',41"—adjustable-resistance plug, male/screw-threads, turning-slot
42,42'—secondary/piston-rod, secondary/piston-flange
43,43'—opposing/piston-rod, abutment-flange
44—overall compound pneumatic/recoil-spring cartridge
45',45"—external/booster-spring, internal/booster-spring
46',46"—spring-purch: forward/aftward
47,47'—abutment-cushion: elastomeric-pad, Belleville-washer
48',48"—fixed support-bushing, fixed secondary/support-bushing
49',49"—piston-rod flange venting-reliefs, slip-fit (relationship to cylinder-wall)
50,50'—tubular piston-rod, travel-limit abutment
51—airgun cartridge retention screwthreads
52—airgun cartridge aft-crown portion
53,53'—forward breech-body, tubular aftward-extension
54,54'—finger-trigger, sear
55,55'—thruster-chamber
56,56'—thruster-piston, annular-seal
57,57',57"—thrust-port, projectile staging-chamber, barrel-bore
58,58'—male/screw-threaded shank, action ref.-arrow
59,59'—knurled manual-adjuster knob, tool-engagable turning device
60—supporting stock of airgun (fragmented)

V.) DETAILED DESCRIPTION OF THE PREFERRED EMBODIMENTS

Prior-art

Initial reference is given by way of FIG. 1, wherein is exhibited a portion of the breech-block body 10 of a circa-1906/Winchester(patent assignee) rifle, which example is believed the first usage of an integrally formed gas/recoil-spring device considered relevant to our instant disclosure: —and wherein the subject air-chamber 11 contains normalized (14.7-psi/sea-level) air maintained via the gun's ambient air-environment, and auxiliary compression-spring 12 impinges against the violent recoil cushioning plunger-piston 13 which is thereby located forwardly against the enlarged-step of the fixed guide-rod 14, but sent aftward by rearward travel of partially shown recoiling piston-abutment 16 (rigidly interconnected with aftwardly movable breech-block body 10), while forward-return recoil-spring 15 yields to force of gas-pressure resulting from the explosive-charge (unshown) at fixed shell-chamber 17 exciting forth through the barrel-bore 18 and from the gun's muzzle, having ultimately sent a projectile forth according to action ref.-arrow 19. This early example remains substantially typical of contemporary design, wherein the activating barrel-bore gas-relief port routes a portion of the explosive gas-pressure against the frontal recoil-piston (which aftward portion is the piston-abutment 16).

New-art

Next, reference to FIG. 2A shows the preferred general configuration of my basic new quick and easy "drop-in" gas-spring conversion cartridge 20 replacement (OEM or aftermarket retrofit) for a conventional metal/recoil-spring substantially equivalent to the primary recoil-spring 15 shown in FIG. 1; —and, while the physical properties of contemporary semi-automatic & fully-automatic firearms are somewhat different, their basic functions remain substantially comparable for patent disclosure comparison purposes hereof. In FIGS. 2A/2B is shown my basic gas-spring units 20 that are factory pressurized (generally in range of 80–150 psi) with an inert-gas (such as highly compressive nitrogen) or natural-air, which is retained within the imperforate gas-chamber 31 formed by the cylindrical-wall 21' made contiguously with a first/end-wall 23 and opposing second/end-wall 24, and in combination with the annular-lip seal 26 impinging upon the micro-polished longitudinally arranged piston-rod 27. The generic variations of FIGS. 2A/2B are found in the manner by which the cylindrical-wall in FIG. 2A is mated to the opposing end-walls 23 and 24 via an annular-seal at 23' and 24' respectively; and the way the opposing cylindrical-wall terminuses are permanently factory-sealed by swedging them over 21" 90-degrees as well. The iteration of FIG. 2B shows the gas-cylinder end-walls 23" and 24" as being formed with oven-brazed joints, so as to eliminate the annular-seals 23' and 24'; —however, the end-walls may alternately be screw-threaded and sealed to the cylindrical-wall portions 21/21' as well.

Because the piston-rod 27 is moved to its maximum-extension (see "Max." ref.-line in FIG. 2A) via the biased urging of positive internal gas-pressure 31 (limited in outward travel by a radial piston-rod abutment flange 27'), and upon activation of the gun's existing mechanical recoil-mechanism which forcibly acts upon the piston-rod's thrust-heel 28 to thereby conversely displace the piston-rod 27 ultimately to approximately its minimum-extension see "Min." ref.-line in FIG. 2A); —it is also desirable to include lateral stabilizing devices. For example, both FIGS. 2A/2B indicate presence of a guiding support-bushing 25 proximal the chamber-seal 26, the seal protective support-bushing 25 perhaps more preferably being located inboard of the seal 26, as is the arrangement in FIG. 2B; plus, another lateral stabilizing device in the form of radial-extensions 27" arranged outwardly of the basic abutment-flange portion 27', thereby effectively eliminating lateral wobble of piston-rod member 27 while facilitating a free slip-fit of the piston-rod relative to the cylinder-structure (owing that effective piston-diameter preferably remains that of piston-rod 27).

Additionally, it will be observed that the piston-rod 27 of FIG. 2A has approximately 1/10th the cross-sectional area as compared to full-bore piston 13 in FIG. 1, thus the associated graphic-chart of FIG. 2C comparatively demonstrates how the preferred smaller cross-sectional area of graphic example-2A (correlating to FIG. 2A) advantageously provides a nearly flat (plotted graphically) compressive resistance increase (or "ramping-up" condition) as the piston-rod becomes transulated through from its maximum to minimum extension (Note: also, because of its relatively small cross-section, even three such skinny piston-rods could be accomodated within the cylinder-chamber). Even the moderate exemplified graphic cross-section 2B (correlating to FIG. 2B) shown in FIG. 2C, having about ½ the cross-sectional area of the full cylinder-bore, is shown to be still substantially lower in compressive resistance increase as compared to the exemplified steeply rising full-cylinder cross-sectional area piston embodiment of plotted ref.-1 (correlating to FIG. 1 in FIG. 2C. Accordingly, by thoughtfully setting both the gas-chamber positive-pressure 32 relative to the piston-rod's 27 cross-sectional area (relative to the cylinder cross-sectional area), and in combination with the effective stroke of the piston-rod 27; —the factory technicians can virtually tune the gas-spring cartridge 20 to ideally suit the breech action travel-rate and thrust-force according to that of a particular firearm (specifically unidentified here).

There remain subtle, however vital other differences which are to become herein more evident and understood as important improvements. For example, FIGS. 3A/3B show how the notion of a gas-spring cartridge 20 can be implemented to operate within the gun in two different ways; —FIG. 3A showing the the breech recoil action is being applied to the thrust-heel 28 of the piston-rod 27, while FIG. 3B shows how the breech recoil action is instead applied to the first/end-wall region 23 (in both examples, the shaded arrow-hear at their left, merely serves to represent a fixed-abutment). Accordingly, it is up to the gas/recoil-spring and firearm designers to determine what parameters act to influence the particular arrangement of gas/recoil-spring installation into a gun in place of a traditional metal/recoil-spring; —it even being anticipated that a gun recoil-mechanism might be engineered which would simultaneously move both the piston-rod 27 and the cylinder-body 21'. Although it is generally recognized that the primary consideration favoring application of the recoil-force to the thrust-heel 28, resides in the usually lower inertial-mass (therefore more responsive) advantage of the piston-rod example of FIG. 2A; —however, there are numerous other contravening factors which the designer must consider as well.

Reference to FIGS. 4A/B/C/D are diagrams showing different iterations of our pneumatic(gas)/recoil-spring version 20' which employs a cylinder-wall 21 having optional regionally necked-down formations serving to provide an additional device by which to regulate the rate of piston-rod movement throughout the travel of the piston-rod upon firing of the gun. In FIG. 4A for example, the forward end of the cylindrical-wall 21' is necked-down via an annular declivity (or continuous step) 30 to a forwardly coaxial and imperforate cylinder-wall 22, which reduced diameter thus comes into contact with the partial-piston 29 carried upon the piston-rod 27. While the oppositely arranged embodiment of FIG. 4B employs the reduced diameter cylinder-wall 22" at the aftward end of the cartridge 20'; and, embodiment of FIG. 4C merely combines both of these to configurations at regions 22 and 22". Another generic-variant is suggested in FIG. 4C, wherein the reduced diameter is instead located medially at 22', although it is understood that another generic-variant would be to optionally continue the cylinder-wall configuration to include either a contiguous forward 22 or aftward 22" portion as well (although not both forward 22 and aftward 22"). Note also, that because the partial-piston 29 preferably includes an annular-seal (not actually indicated in FIGS. 4/A/B/C/D), then it is considered important to include a generally L-shaped venting passageway 29" or equivalent tiny vent-hole (controlled relief not shown) longitudinally through the partial-piston 29 to prevent an air-lock condition, otherwise a leakage-gap at annular region 29' would generally be necessitated to allow full linear travel (unless as in some adaptations, it be intended that a pneumatic-cushion condition be created particularly at the extreme forward 30 or aftward 30" necked-down regions).

Reference to FIG. 5 shows a further gas-spring iteration, here again exemplified as including piston-rod 27 with the radial abutment-flange 27' shown deployed proximal 2nd/end-wall 24 having fixed lip-seal 26 to retain positive/gas-pressure 32' within the imperforate rigid gas-chamber confines defined by cylindrical internal-surface 21 and opposing 1st/end-wall 23. Plus, arranged coaxially thereto is an adjoining recoil-chamber 39 serving to hold an inertial-mass device 40 normally biased forwardly to abut proximal the now partition like 1st/end-wall 23 via force of compression-spring 40' preloaded by adjustable-plug 41 having male/screw-threads 41' coacting with the female/screw-threads 39' made partially into the recoil-chamber 39. The adjustable-plug 41 is preferably made easily field-tunable without aid of special tools, by simply inserting an ordinary pocket-coin (such as a quarter-dollar) into transverse turn-slot 41" (or an ordinary screwdriver will sulfice). In operation, when the gun is fired the breech-action exerts a load (see ref.-arrow) upon the thrust-heel 28 sending the piston-rod 27 aftward to the phantom-indicated position, whereupon the inertial-mass device 40 reacts to arrest much of the guns remaining recoil not entirely dampened by the gas-spring portion. By exerting a compressive force upon the counter-spring 40', much of the remaining recoil energy becomes expended therein; —and this can be precisely tailored to suit a particular type of ammunition simply by turning of longitudinally screw-threaded adjustment-plug 41.

Figure 6A:
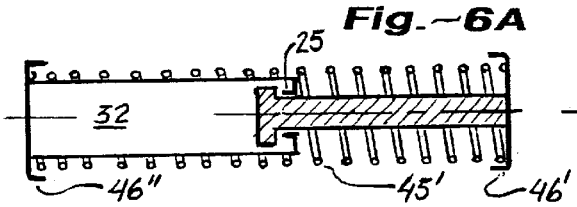
FIG. 6A, is a diagrammatic side/elevation-view showing the optional combination of a metal/compression-spring coaxially without the gas-cartridge.
Figure 6B:
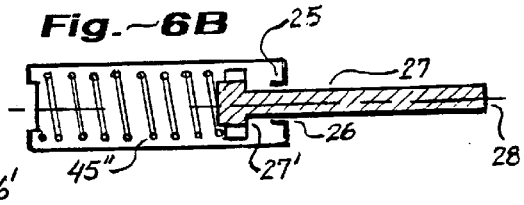
FIG. 6B, is an alternate generic-variant thereof, showing the combination of a metal/compression-spring contained within the gas-cartridge.

Next in FIG. 6A is shown an example of a gas-cartridge 20 combined with an external resistance bolstering metal/counter-recoil spring 45', while companion FIG. 6B shows an alternate variant embodiment having a substantially equivalent metal/counter-recoil spring 45" arranged within the gas-cartridge. The usefullness of both these two iterations being to facilitate inordinately high recoil loads imposed by certain types of guns.

Figure 7A:
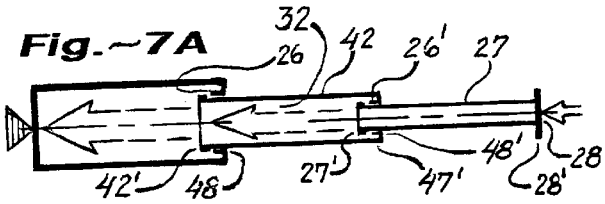
FIG. 7A, is a diagrammatic side/elevation-view looking at a right-angle to the longitudinal-axis cross-section of my basic new-art gas/recoil-spring unit, wherein is also included a concentric secondary telescopic coaxial element.

In FIGS. 7A/B are set forth further generic-variant embodiments of gas/recoil-springs 44 featuring compound telescopic capability particularly useful in gun breech-mechanisms where longitudinal space for a recoil-spring is relatively confined, yet recoil travel requirement remains substantial. The diagrammatic example of FIG. 7A shows a three-section telescopic embodiment, wherein the telescopic piston-rod section 27 having radial extension-flange 27' is now impinging proximal the fixed secondary support-bushing 48', and is longitudinally supplemented with an additional intermediate axially-concentric secondary/piston-rod member 42 having abuting piston-flange 42' as to likewise limit its outward longitudinal extension travel by impinging proximal the fixed support-bushing 48. Accordingly, although both of the telescopic sections retract substantially within the cylindrical-wall 21, the smaller-diameter piston-rod member 27 is first to recede, owing that the larger effective cross-sectional piston-diameter of piston-rod member 42 poses greater resistance, thus retracting once the radial extension-flange 28' of the piston-rod thrust-heel 28 is proximal the abutment-cushion region 47' of the secondary/piston-rod 42.

Figure 7B:
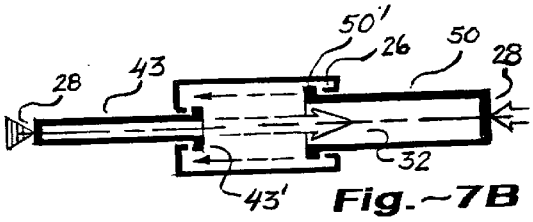
FIG. 7B, is a diagrammatic side/elevation-view looking at a right-angle to the longitudinal-axis cross-section of my basic new-art gas/recoil-spring unit, wherein is also included a opposite semi-concentric telescopic coaxial element.
Figure 8:
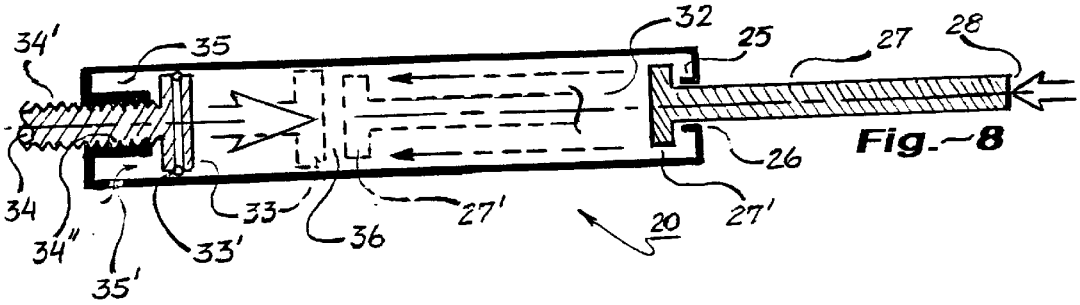
FIG. 8, is a diagrammatic side/elevation-view looking at a right-angle to the longitudinal-axis cross-section of my basic new-art gas/recoil-spring unit, wherein is also included a full-bore slider-piston device facilitating external selective adjustment of the primary chamber-pressure for fine-tuning of recoil according to amplitude of explosive-charge being fired.

An effectively quite similar two-stage collapse action is realized by the opposed/piston-rod configuration of FIG. 7B, wherein the smaller opposing/piston-rod 43 is first to recede, followed by the opposite retraction of the larger coaxial piston-rod 50 it is believed that selection of either of the two configurations is substantially a matter of engineering-design choice; however, the FIG. 7A version does enable more practical implementation of my convenient manual internal pneumatic-pressure adjuster device next revealed in FIG. 8, which would necessarily have to be installed within an elongated hollow piston-rod 50 thrust-heel region 28 (actually either version, requiring lengthening of the pneumatic-spring cartridge to accommodate my adjustment mechanism revealed in FIG. 8).

In FIG. 8 is shown a very useful enhancement to my gas/recoil-spring, which features a convenient manually selective adjustment of the instant gas-pressure amplitude within the gas-spring assembly 20. Here we see my preferred piston-rod member 27 and 27' in combination with a selectively adjustable compression-piston 33 fitted with conventional annular-seal 33', while secured dependent from a longitudinally adjustable support-shaft 34 having screw-threads mating intimately into fixed aftward anchor-boss having female/screw-threads 34". The support-shaft's outermost terminus would be made longitudinally of sufficient length as to attain the desired amount of longitudinal travel, and include a suitable type of conventional positive-fitment for receiving longitudinal insertion of an alien-key tool (unshown), or a plain screw-driver transverse-slot (unshown), or receptacle for a longitudinally inserted phillips screw-driver (unshown), —or other equivalent tool by which to thereby turn support-shaft 34 either CCW(counter-clockwise) to receed compression-piston 33 (hence reducing gas-pressure prevailing therein); —or CW(clockwise) to advance compression-piston 33 into adjacent imperforate gas-chamber 32 (hence increasing the gas-pressure prevailing therein).

In the two FIGS. 9A/9B are revealed examples of how I prefer to employ a pair of interacting permanent-magnets (PM) in order to enhance the operation of my gas-spring apparatus for guns of most any type. In FIG. 9A is shown my basic gas-spring cartridge body 20" and cooperating piston-rod 27, and wherein I have affixed a preferably rare-earth (ultimately more powerful) type permanent repulsion-magnet 37 proximal the aftward most (or equivalent) end-wall 23", and an opposing dynamic repulsion-magnet 37' unit proximal the inboard most terminus of the piston-rod 27. Hence in operation, function of the piston-rod 27 is normal as it is driven into gas-chamber 32 by action of the breech-mechanism (unshown), —however, as movable (dynamic) magnet 37' arrives close to fixed(static) magnet 37, the magnetic-fields of the two magnets interact in strong opposition to very effectively decelerate piston-rod 27. Thus, with the magnetic-polarities of the two interacting magnets being arranged to interface in a like manner (+:+ or −:−), the magnets thereby function as an advantageously non-resonating (ie—not having an audible resonate-frequency) manner, more ideally (than the examples of my FIGS. 6A/6B) keeping with the premise of my instant invention disclosure. In my alternate related example of FIG. 9B is shown a way of employing a pair of permanent-magnets to attain a highly resistive breakaway-force action, which can be very effectively combined with the permanent-magnet arrangement of FIG. 9A if desired. In my FIG. 9B iteration, the moving(dynamic) and preferably annular 38' is necessarily affixed proximal the inboard most terminus of piston-rod 27, while annular static/attraction-magnet 38 is affixed proximal second/end-wall 24"; —although in this example, the magnetic-field polarities of the respective magnet elements are arranged conversely to that set forth in FIG. 9A. Therefore, the piston-rod 27 held at it's extreme extended condition, both by force of the pressurized-gas acting within the cartridge-chamber 32, and now by the additional attraction-force of interacting magnets 38 and 38' thereby compel the piston-rod 27 to dwell longer at it's fully deployed position, —while the high-explosive gases are first acting to send the projectile(bullet) down the bore of the gun before sufficient explosive-gasses are generated as to enable the breech-mechanism (unshown) to overcome the recoil-resistance being posed by this combination gas-spring/magnetic-resistance type of specialized anti-recoil cartridge-unit. It has been found that the breakaway action characteristic provided by my FIG. 9B magnetic breech-retention embodiment offers an ultimately smoother firing-action than that known to conventional cam-action breech-mechanisms, plus there is lower maintenance, less jamming, and no cam-lubricant requirement.

Finally, in FIGS. 10A/10B are shown two examples of a special airgun adaptation of my gas-spring assembly invention, which are herein set forth both as a form of "drop-in" air-spring thruster-cartridge 20" in FIG. 10A, and alternately as an entirely "integral" (built-in) thruster embodiment thereof in FIG. 10B; —both iterations including my field-adjustable thrust-pressure feature, as is notably related to that shown in preceding FIG. 8 herein for explosive-powder firearms (note: FIGS. 10 are facing opposite direction to the other FIGS.). While both embodiments exhibit substantially the same projectile thrusting performance the advantage of being field-adjustable resides in being able to use substantially lower propulsion-pressure for close-range targeting-practice, while alternately for example being readily readjustable to a much higher propulsion-pressure, for long-range targeting-practice distances. Thus, my airgun gas-spring cartridge embodiment 20" of FIG. 10A is herein exemplified as being entirely installable/removable via male/female-screwthreads 51 cooperating between the cartridge-body aft-crown 52 and the tubular aftward-extension 53' of the breech-body. The mating screwthreads 51 could also obviously be facilitated in the form of a well know rotary-bayonet type positive engagement arrangement; —or, various other positive-retention means can be resorted to, with the object necessarily being to provide a solid mounting of the thruster-cartridge relative to the breech-body, capable in any case of withstanding the high-compression loadings encountered in the forward breech-body 53 portion, as the piston-rod 27 is released by an exemplified sear-device 54'. Upon release, gas-pressure contained within the canister-body 20" instantly drives the piston-rod 27 forward, plunging thuster-piston 56 to a final non-impacting position proximal thrust-port 57 arranged immediately afward of the conventional projectile staging-chamber region 57'. The ensuing high high-pressure build-up against the back of a projectile resting within the conventional staging-chamber 57, thereby instantly expels the projectile (unshown), characterized such as a standard lead/zink-pellet, tranquilizer-dart, or liquid-ingredient (optional chemistry) filled polymer-ball, —out through the barrel-bore 57' of the airgun. In both FIGS. 10A/10B the male/screw-threaded shank 58 is manually rotated-in/out (see action ref.-arrow 58') either via knurked-knob member 59 (FIG. 10A) or via a screw-driver slot 59' (FIG. 10B) or equivalent tool-engaging turning device, —to finitely-adjust the contained gas-pressure; —thereby shifting the appended compression-piston 33 member either toward(to variably-increase the gas-pressure) or away relative to the first/end-wall 24 (to conversely variably-reduce the gas-pressure).

Thus, it is readily understood how the preferred and generic-variant embodiments of this invention contemplate performing functions in a novel way not heretofore available nor realized. It is implicit that the utility of the foregoing adaptations of this invention are not necessarily dependent upon any prevailing invention patent; and, while the present invention has been well described hereinbefore by way of certain illustrated embodiments, it is to be expected that various changes, alterations, rearrangements, and obvious modifications may be resorted to by those skilled in the art to which it relates, without substantially departing from the implied spirit and scope of the instant invention. Therefore, the invention has been disclosed herein by way of example, and not as imposed limitation, while the appended Claims set out the scope of the invention sought, and are to be construed as broadly as the terminology therein employed permits, reckoning that the invention verily comprehends every use of which it is susceptible. Accordingly, the embodiments of the invention in which an exclusive property or proprietary privilege is claimed, are defined as follows.

What is claimed of proprietary inventive origin is:

1.) A method of converting a conventional metal/recoil-spring buffered firearm into a pneumatic/recoil-spring buffered gun for improved modulation of counter-recoil action;

said method comprising:

first, extracting the metal/recoil-spring from its operating cavity as to spatially enable retrofitting;

then, inserting a pneumatically charged cylinder having coacting piston-rod assembly which is diametrically and lengthly sized to specifically occupy said gun operating cavity formerly housing the removed metal/recoil-spring, said pneumatically charged cylinder being devoid of and, operating independently of any, metal springs.

* * * * *